US009512801B2

(12) United States Patent
Nishimura

(10) Patent No.: US 9,512,801 B2
(45) Date of Patent: Dec. 6, 2016

(54) FUEL INJECTION CONTROLLER

(71) Applicant: DENSO CORPORATION, Kariya, Aichi-pref. (JP)

(72) Inventor: Toshio Nishimura, Anjo (JP)

(73) Assignee: DENSO CORPORATION, Kariya (JP)

( * ) Notice: Subject to any disclaimer, the term of this patent is extended or adjusted under 35 U.S.C. 154(b) by 280 days.

(21) Appl. No.: 14/013,249

(22) Filed: Aug. 29, 2013

(65) Prior Publication Data

US 2014/0069389 A1 Mar. 13, 2014

(30) Foreign Application Priority Data

Sep. 13, 2012 (JP) ..... 2012-202004

(51) Int. Cl.
*F02D 41/20* (2006.01)
*F02D 41/30* (2006.01)

(52) U.S. Cl.
CPC ..... *F02D 41/30* (2013.01); *F02D 41/20* (2013.01); *F02D 2041/2051* (2013.01); *F02D 2041/2055* (2013.01); *F02D 2041/2058* (2013.01)

(58) Field of Classification Search
CPC .. F02D 41/20; F02D 41/30; F02D 2041/2055; F02D 2041/2058; F02D 2041/2079
USPC ..... 123/467, 490, 499, 470; 239/533.3, 239/585.1, 585.3
See application file for complete search history.

(56) References Cited

U.S. PATENT DOCUMENTS 5,375,575 A * 12/1994 Ohishi ..... F02D 41/0085 123/446
5,992,391 A 11/1999 Yamakado et al.
2005/0073795 A1* 4/2005 Maekawa ..... F02D 41/20 361/160

(Continued)

FOREIGN PATENT DOCUMENTS

JP S56-009626 A 1/1981
JP H03-149313 A 6/1991

(Continued)

OTHER PUBLICATIONS

Office Action mailed Aug. 19, 2014 issued in corresponding JP patent application No. 2012-202004 (and English translation).

(Continued)

*Primary Examiner* — Hai Huynh
*Assistant Examiner* — Gonzalo Laguarda
(74) *Attorney, Agent, or Firm* — POSZ LAW GROUP, PLC

(57) ABSTRACT

A fuel injection controller is provided with a detection control portion which detects a valve-opening time. The detection control portion supplies the low valve-opening voltage to the fuel injector from a low voltage supply. An electric current flowing through a coil is gradually increased. When the fuel injector is fully opened, an inflection point appears on a waveform of an electric current. A valve-open detecting portion detects the inflection point and identifies a valve-opening time. A correction-amount computing portion computes a correction amount of a fuel injection quantity due to an error of the valve-opening time. In a succeeding fuel injection, the correction portion corrects an electric supply period. As a result, the error of the fuel injection quantity due to an error of valve-opening time is corrected.

14 Claims, 4 Drawing Sheets

(56) References Cited

U.S. PATENT DOCUMENTS

| | | | | |
|---|---|---|---|---|
| 2008/0276907 | A1* | 11/2008 | Abe | F02D 41/20 123/472 |
| 2009/0121724 | A1 | 5/2009 | Perryman et al. | |
| 2009/0132180 | A1* | 5/2009 | Pearce et al. | 702/38 |
| 2011/0100333 | A1 | 5/2011 | Toyohara et al. | |
| 2015/0144109 | A1* | 5/2015 | Mukaihara | F02D 41/2467 123/490 |

FOREIGN PATENT DOCUMENTS

| | | | |
|---|---|---|---|
| JP | 2001-193508 | A | 7/2001 |
| JP | 2001-221121 | A | 8/2001 |
| JP | 2001-280189 | A | 10/2001 |
| JP | 2009-138639 | A | 6/2009 |
| JP | 2010-073705 | A | 4/2010 |
| JP | 2010-532448 | A | 10/2010 |
| WO | 2013/191267 | A1 | 12/2013 |

OTHER PUBLICATIONS

Office Action mailed Aug. 19, 2014 issued in corresponding JP patent application No. 2012-202005 (and English translation).
U.S. Appl. No. 14/013,695, filed Aug. 29, 2013, Toshio Nishimura.
U.S. Appl. No. 14/017,579, filed Sep. 4, 2013, Toshio Nishimura.
Office Action issued Dec. 15, 2015 in co-pending U.S. Appl. No. 14/017,579.

* cited by examiner

FUEL INJECTION CONTROLLER

CROSS-REFERENCE TO RELATED APPLICATION

This application is based on Japanese Patent Application No. 2012-202004 filed on Sep. 13, 2012, the disclosure of which is incorporated herein by reference.

TECHNICAL FIELD

The present disclosure relates to a fuel injection controller which controls a fuel injector.

BACKGROUND

JP-2010-532448A, JP-2010-73705A and JP-2001-221121A disclose a fuel injection controller which controls a fuel injector. Especially, JP-2001-221121A discloses that a valve-opening time of a fuel injector is detected by detecting an inflection point on a waveform of a coil current. Furthermore, these patent documents disclose that an error of a fuel injector is corrected based on the detected valve-opening time so that an accuracy of a fuel injection quantity is improved.

It is required that a fuel injector has high responsiveness. For example, when a voltage is applied to the fuel injector, the fuel injector actually opens to inject a fuel in a short period. That is, it is preferable that a valve-opening delay is short. In order to shorten the valve-opening delay, the fuel injector is driven by high voltage and large current at a beginning of valve-opening. However, it is difficult to detect a characteristic point, such as an inflection point, on the waveform of coil current in a condition where the fuel injector is driven by high voltage and large current.

In order to detect the valve-opening time, further improvements are necessary in a fuel injection controller.

SUMMARY

It is an object of the present disclosure to provide a fuel injection controller which can detect a valve-opening time of a fuel injector.

Further, a fuel injection controller can correct an error of a fuel injection quantity due to an error of valve-opening time.

A fuel injection controller has terminals connectable to a coil of a fuel injector. The fuel injection controller has a usual-control portion which supplies a high valve-opening voltage to the terminals in order to perform a fuel injection by the fuel injector, a detection control portion which supplies a low valve-opening voltage lower than the high valve-opening voltage to the terminals in order to perform a fuel injection by the fuel injector; and a valve-open detecting portion which detects the fuel injector is positioned at a full-open position by detecting an inflection point on a waveform of an electric current flowing through the coil when the low valve-opening voltage is supplied.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Referring to drawings, an embodiment of the present disclosure will be described hereinafter.

Figure 1:
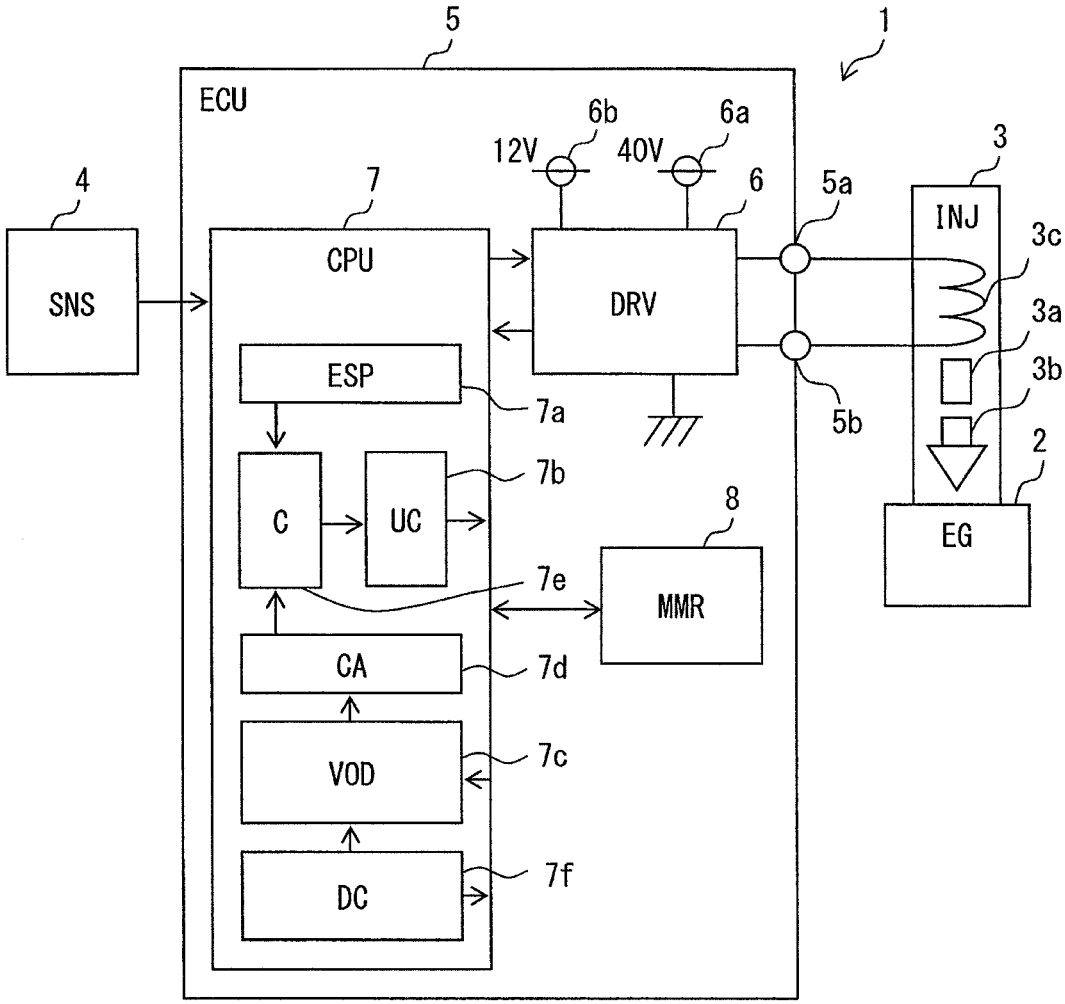
FIG. 1 is a block diagram showing an internal combustion engine system according to a first embodiment.

FIG. 1 shows an internal combustion engine system 1 according to a first embodiment. The internal combustion engine system 1 is provided with an internal combustion engine 2 for a vehicle. The internal combustion engine system 1 is provided with a fuel feed system for supplying a fuel to the internal combustion engine 2. A fuel feed system is provided with a fuel injector (INJ) 3, a plurality of sensors (SNS) 4, and a fuel injection controller (ECU) 5.

The fuel injector 3 is a normally-closed type solenoid valve. The fuel injector 3 receives pressurized fuel from a fuel pump (not shown). When the fuel injector 3 is opened, the pressurized fuel is injected into the internal combustion engine 2. The fuel injector 3 is arranged in an intake passage of the internal combustion engine 2. In this case, the fuel injector 3 injects the fuel towards the intake air and forms an air-fuel mixture. Alternatively, the fuel injector 3 can be arranged to a cylinder head of the internal combustion engine 2. In this case, the fuel injector 3 injects the fuel towards a combustion chamber.

The fuel injector 3 is comprised of a stator 3*a* including a fixed core, a needle 3*b* including a movable valve and a movable core, and a coil 3*c* for magnetizing the stator 3*a*. The coil 3*c* is a magnet coil. When the coil 3*c* is energized, the needle 3*b* is magnetically attracted toward the stator 3*a*. The needle 3*b* is biased in a valve-closing direction by a spring (not shown).

When the coil 3*c* is not energized, the needle 3*b* is biased in a valve-closing direction. Thus, the fuel injector 3 injects no fuel. When the coil 3*c* is energized, the needle 3*b* is magnetically attracted toward the stator 3*a*. The fuel injector 3 is opened to inject the fuel. There is a specified time delay from when the coil 3*c* is energized until when the fuel injector 3 is opened. When the coil 3*c* is deenergized, the fuel injector 3 is closed to stop the fuel injection. There is a specified time delay from when the coil 3*c* is deenergized until when the fuel injector 3 is closed.

The sensors 4 are for controlling the internal combustion engine 2. For example, the sensors 4 include an accelerator sensor, an engine speed sensor, and an intake-air sensor detecting an intake air quantity.

The fuel injection controller 5 is an electronic control unit (ECU). The ECU 5 has terminals 5*a* and 5*b*, which can be connected to the coil 3*c* of the fuel injector 3. The ECU 5 is provided with a drive circuit (DRV) 6 which controls the voltage supplied to the coil 3*c* and the electric current flowing into the coil 3*c*. The drive circuit 6 has a high voltage supply 6*a* for driving the fuel injector 3 at high speed, and a low voltage supply 6*b* for driving the fuel injector 3 at low speed.

The high voltage supply 6*a* is connected to a booster circuit which boosts a battery voltage. The voltage "VF1" of the high voltage supply 6*a* is 40V. The high voltage supply 6*a* supplies the high voltage to the fuel injector 3 so that the fuel injector 3 is driven from a full-close position to a full-open position.

The low voltage supply 6*b* is connected to a battery of a vehicle. The Voltage "VF2" of the low voltage supply 6*b* is lower than the voltage "VF1" of the high voltage supply 6*a*. The low voltage supply 6*b* supplies the low voltage to the fuel injector 3 so that the fuel injector 3 is driven from a full-close position to a full-open position. The high voltage and the low voltage supplied from the high voltage supply 6*a* and the low voltage supply 6*b* are referred to as a valve-opening voltage. The low valve-opening voltage corresponds to a detection voltage for detecting an inflection point indicating that the fuel injector 3 is fully opened, from a waveform of the electric current flowing through the coil 3*c*. The low valve-opening voltage also corresponds to a sustaining voltage for supplying the electric current to the fuel injector 3 so that the fuel injector 3 is stably positioned at the full-open position. The voltage "VF2" of the low voltage supply 6*b* is 12V.

The ECU 5 has a processing unit (CPU) 7 and a memory (MMR) 8 in which programs are stored. The ECU 5 is a microcomputer having a memory media. The memory media stores various programs which the computer executes. The memory media is a semiconductor memory or a magnetic disc.

The CPU 7 executes the programs stored in the memory 8 to perform a control of the fuel injector 3. The CPU 7 has a plurality of control portions.

The CPU 7 functions as an injection control unit which controls the fuel injector 3 to inject the fuel of the quantity which the internal combustion engine 2 needs. The injection control unit determines a valve-opening period of the fuel injector 3 in order to adjust the fuel injection quantity. The fuel injection quantity can be adjusted from a small injection quantity to a normal injection quantity. The small injection quantity is obtained by stopping a supply of the valve-opening voltage before the fuel injector 3 reaches the full-open position from the full-close position. The normal injection quantity is obtained by stopping a supply of the valve-opening voltage after the fuel injector 3 reaches the full-open position.

The CPU 7 has an electric-supply-period computing portion 7*a*. The electric-supply-period computing portion 7*a* determines an electric supply period "TS" during which the valve-opening voltage is applied to the fuel injector 3 to be opened. A valve-open-delay period "TL" is subtracted from the electric supply period "TS". Then, a valve-close-delay period "TT" is added to obtain a valve-opening period of the fuel injector 3. Therefore, the electric supply period "TS" is equivalent to a target fuel injection quantity "Q". When injecting the small injection quantity, the electric supply period "TS" is defined in such a manner that the supply of the valve-opening voltage is stopped before the fuel injector 3 reaches the full-open position from the full-close position.

The CPU 7 has a usual-control portion 7*b*. The usual-control portion 7*b* is for executing a usual fuel injection control. When the usual fuel injection control is executed, the fuel injector 3 is driven at high speed. When the usual fuel injection control is executed, no inflection point is detected from the waveform of the electric current. When the usual fuel injection control is executed, it is not detected that the fuel injector 3 reaches the full-close position.

The usual-control portion 7*b* supplies the valve-opening voltage to the terminals 5*a*, 5*b* to which the fuel injector 3 is connected. After a specified period has passed, the valve-opening voltage is stopped to be supplied. The usual-control portion 7*b* supplies the high valve-opening voltage to the terminals 5*a*, 5*b* temporarily. The usual-control portion 7*b* controls the drive circuit 6 in such a manner that the high voltage supply 6*a* intermittently supplies the electricity to the coil 3*c*. Thereby, the valve-opening voltage is supplied to the coil 3*c*, so that a magnetizing current flows. The usual-control portion 7*b* moves the needle 3*b* in a valve-opening direction.

When supplying the small injection quantity, the usual-control portion 7*b* stops the supply of the high valve-opening voltage "VF1" to the coil 3*c* before the fuel injector 3 reaches the full-open position. Thereby, the fuel injection of small quantity can be obtained. Moreover, the usual-control portion 7*b* can stop the energization of the coil 3*c* after the fuel injector 3 reaches the full-open position.

The usual-control portion 7*b* adjusts the electric power supplied to the coil 3*c* so that the fuel injector 3 is fully opened promptly in an early stage of electric supply period "TS". The usual-control portion 7*b* can adjust the electric power supplied to the coil 3*c* so that the fuel injector 3 is stably maintained at a full-open position in a latter stage of electric supply period "TS". The latter stage of electric supply period "TS" may correspond to a period between a time when the fuel injector 3 is fully opened and a time when the electric supply period "TS" ends. In this embodiment, the usual-control portion 7*b* supplies the high valve-opening voltage to the coil 3*c* from the high voltage supply 6*a* in the early stage of electric supply period "TS", and supplies the low valve-opening voltage to the coil 3*c* from the low voltage supply 6*b* in the latter stage of electric supply period "TS". Furthermore, in this embodiment, the usual-control portion 7*b* restricts the electric current flowing through the coil 3*c* in the latter stage of electric supply period TS so that the fuel injector 3 is stably maintained at a full-open position.

The usual-control portion 7*b* changes the voltage supplied to the terminals 5*a*, 5*b* into a valve-opening voltage (+40V) in the valve-opening time. After the electric supply period "TS" has elapsed, the usual-control portion 7*b* changes the voltage supplied to the terminals 5*a*, 5*b* into a valve-closing voltage. The valve-closing voltage is for moving the fuel injector 3 in a valve closing direction and maintaining the fuel injector 3 at the fuel-close position. The valve-closing voltage may be a stopping voltage (zero Volt) of when not driving the fuel injector 3.

The usual-control portion 7*b* may perform a demagnetization control in order to quickly attenuate the residual magnetization energy remaining in the coil 3*c*. The demagnetization control can be performed after the supply of the valve-opening voltage is stopped. For example, the demagnetization control can be conducted by a closed circuit having the coil 3*c*. The residual magnetization energy is quickly decreased by energizing the closed circuit having the coil 3*c*. The closed circuit may have a reverse-direction power source, a switching device and a resistor. The reverse-direction power source can supply a reverse voltage to the coil 3*c*. The reverse voltage accelerates the attenuation of residual magnetization energy.

The CPU 7 has a valve-open detecting portion 7*c*. The valve-open detecting portion 7*c* detects that the fuel injector 3 is at the full-open position by detecting an inflection point on a waveform of an electric current "IL" flowing in the coil 3*c* through the terminals 5*a*, 5*b*. The valve-open detecting portion 7*c* detects the inflection point when the low valve-opening voltage is supplied to the coil 3*c* from the low voltage supply 6*b*. In other words, the valve-open detecting portion 7*c* responds to a detection control portion 7*f* and detects the inflection point while the low valve-opening voltage is supplied to the coil 3*c*. The valve-open detecting portion 7*c* detects the inflection point on the waveform of the electric current "IL", which is due to a variation of the inductance of the coil 3*c*. The valve-open detecting portion 7*c* corresponds to an inflection point detecting portion.

The inductance of the coil 3*c* varies according to a position of the needle 3*b* and its movements. The electric current "IL" also varies according to the position of the needle 3*b*. Especially, when the needle 3*b* is positioned at the full-open position, the waveform of the electric current "IL" varies not smoothly. This variation appears as an inflection point on the waveform of electric current "IL". The inflection point on a waveform can be detected by mathematical processing. For example, the inflection point can be detected by differentiation processing and/or integration processing.

At a time when the inflection point occurs, the fuel injector 3 is at full-open position. That is, it is an actual valve-opening time. The valve-open detecting portion 7*c* detects an inflection point in a single fuel injection conducted by the detection control portion 7*f*, whereby an actual valve-opening time of the fuel injection is identified. Therefore, by detecting the inflection point on the waveform of the electric current in a preceding fuel injection, the valve-opening time of the preceding fuel injection is identified.

The valve-opening time varies due to various factors, such as a mechanical error of the fuel injector, an error of electric current, an error of voltage, and a variation in temperature. Therefore, by detecting the valve-opening time, a difference between the valve-opening time and an intended target valve-opening time is obtained. That is, an error of the fuel injection quantity "Q" can be obtained. Furthermore, based on the valve-opening time, the electric supply period "TS" can be corrected in such a manner as to obtain the intended fuel injection quantity "Q".

The CPU 7 has a correction-amount computing portion 7*d*. Based on the valve-opening time in the preceding fuel injection, the correction-amount computing portion 7*d* computes a correction amount "Te" of the electric supply period "TS" in a succeeding fuel injection. When the valve-opening time in the preceding fuel injection is earlier than the target valve-opening time, the correction amount "Te" is established to decrease the electric supply period "TS" in the succeeding fuel injection. When the valve-opening time in the preceding fuel injection is later than the target valve-opening time, the correction amount "Te" is established to increase the electric supply period "TS" in the succeeding fuel injection.

The CPU 7 has a correction portion 7*e*. The correction portion 7*e* corrects at least one of the electric supply period "TS" which the electric-supply-period computing portion 7*a* establishes based on the correction amount "Te" and a parameter for usual controlling by the usual-control portion 7*b*.

According to another embodiment, in the correcting processing, a valve-open-delay period in a preceding fuel injection is obtained. The valve-open-delay period is a period from when the low valve-opening voltage "VF2" is supplied until the valve-opening time. Based on the valve-open-delay period of preceding fuel injection, the electric supply period "TS" in succeeding fuel injection is corrected, so that the valve opening period in succeeding fuel injection becomes the target valve opening period which the electric-supply-period computing portion 7*a* computes. Based on the error of the valve-open-delay period in the preceding fuel injection relative to the target valve-open-delay period, an error of the valve-open-delay period relative to the target valve-open-delay period in succeeding fuel injection is estimated. An error of the fuel injection quantity due to the above error is compensated. The target valve-open-delay period may have an allowable range.

According to the above configuration, the correction-amount computing portion 7*d* and the correction portion 7*e* function as a correction processing portion. The correction processing portion corrects the parameter in succeeding fuel injection so that an error of the fuel injection quantity resulting from the error of the valve-opening time in succeeding fuel injection and the target valve-opening time may be decreased based on the valve-opening time detected in the preceding fuel injection. The parameter is the electric supply period "TS", for example. Thus, the intended fuel injection quantity can be obtained correctly.

The CPU 7 has the detection control portion 7*f* which supplies a detection voltage to the terminals 5*a*, 5*b*. The detection control portion 7*f* supplies the low valve-opening voltage to the coil 3*c*. The detection control portion 7*f* does not supply the high valve-opening voltage to the coil 3*c*. The detection control portion 7*f* supplies the low valve-opening voltage in such a manner that a clear inflection point appears on the waveform of electric current "IL". The inflection point indicates that the fuel injector 3 is positioned at the full-open position. Since the low valve-opening voltage is lower than the high valve-opening voltage, it is easier to observe the waveform of electric current "IL" flowing through the coil 3*c*. A value of the low valve-opening voltage is established in such a manner that the fuel injector 3 is driven more slowly than usual. The value of the low valve-opening voltage is established in such a manner that a clear inflection point appears on the waveform of electric current "IL". The detection control portion 7*f* is for executing a fuel injection for detection.

The detection control portion 7*f* supplies the low valve-opening voltage to the terminals 5*a*, 5*b* to which the fuel injector 3 is connected. After a specified period has passed, the low valve-opening voltage is stopped to be supplied. The detection control portion 7*f* controls the drive circuit 6 in such a manner that the low voltage supply 6*b* intermittently supplies the electricity to the coil 3*c*.

The detection control portion 7*f* has a stop circuit for maintaining the fuel injector 3 at the full-close position. The detection control portion 7*f* changes the voltage supplied to the terminals 5*a*, 5*b* into the low valve-opening voltage in the valve-opening time. After the electric supply period "TS" has elapsed, the detection control portion 7*f* changes the voltage supplied to the terminals 5*a*, 5*b* into the valve-closing voltage.

When the low valve-opening voltage "VF2" is supplied to the coil 3*c* by the detection control portion 7*f*, the valve-opening time is detected by the valve-open detecting portion 7*c*. Meanwhile, the correction amount "Te" is utilized when the high valve-opening voltage "VF1" is supplied to the coil 3*c* by the usual-control portion 7*b*. Therefore, in the correction-amount computing portion 7*d*, the valve-opening time detected by the valve-open detecting portion 7*c* is utilized in order to estimate an error of the valve-opening time of when the high valve-opening voltage "VF1" is supplied to the coil 3*c*. For example, a predetermined conversion processing is conducted for compensating the difference of the valve-opening time due to a difference between the high valve-opening voltage "VF1" and the low valve-opening voltage "VF2". For example, a normalizing process is conducted.

Figure 2:
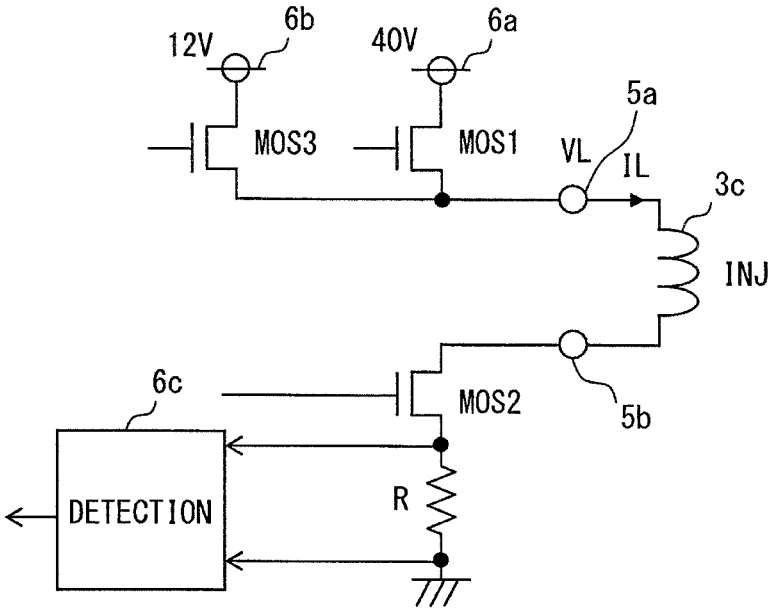
FIG. 2 is a circuit diagram of a driving circuit according to the first embodiment.

As shown in FIG. 2, the drive circuit 6 is provided with a MOS1 between the high voltage supply 6*a* and the plus terminal 5*a*. The MOS1 functions as a high side switch for supplying the high valve-opening voltage. A MOS2 is provided between the minus terminal 5*b* and the earth potential.

The MOS2 functions as a low side switch. A MOS3 is provided between the low voltage supply 6*b* and the plus terminal 5*a*. The MOS3 functions as a high side switch for supplying the low valve-opening voltage. Therefore, an electric power can be supplied to the coil 3*c* from the high voltage supply 6*a* or the low voltage supply 6*b*. The drive circuit 6 can selectively supply the high valve-opening voltage "VF1" or the low valve-opening voltage "VF2" to the terminals 5*a*, 5*b*. The high valve-opening voltage "VF1" is for opening the fuel injector 3 at high speed. The low valve-opening voltage "VF2" is for opening the fuel injector 3 slowly.

A resistor "R" is provided between the MOS2 and the earth potential. A voltage drop in the resistor "R" shows the electric current "IL". The voltage drop in the resistor "R" is detected by a detection circuit 6*c*. The detected voltage drop is transmitted to the CPU 7. The detection circuit 6*c* detects the electric current "IL" by detecting the voltage drop in the resistor "R". The detection circuit 6*c* detects the electric current "IL" in such a manner that an inflection point can be identified by mathematical process in the valve-open detecting portion 7*c*.

The MOS1, the MOS2, and the MOS3 are switching devices. These switching devices are power MOSFET (metal oxide semiconductor field effect transistor). The switching device may be a bipolar transistor, or an IGBT (insulated gate type bipolar transistor).

Figure 3:
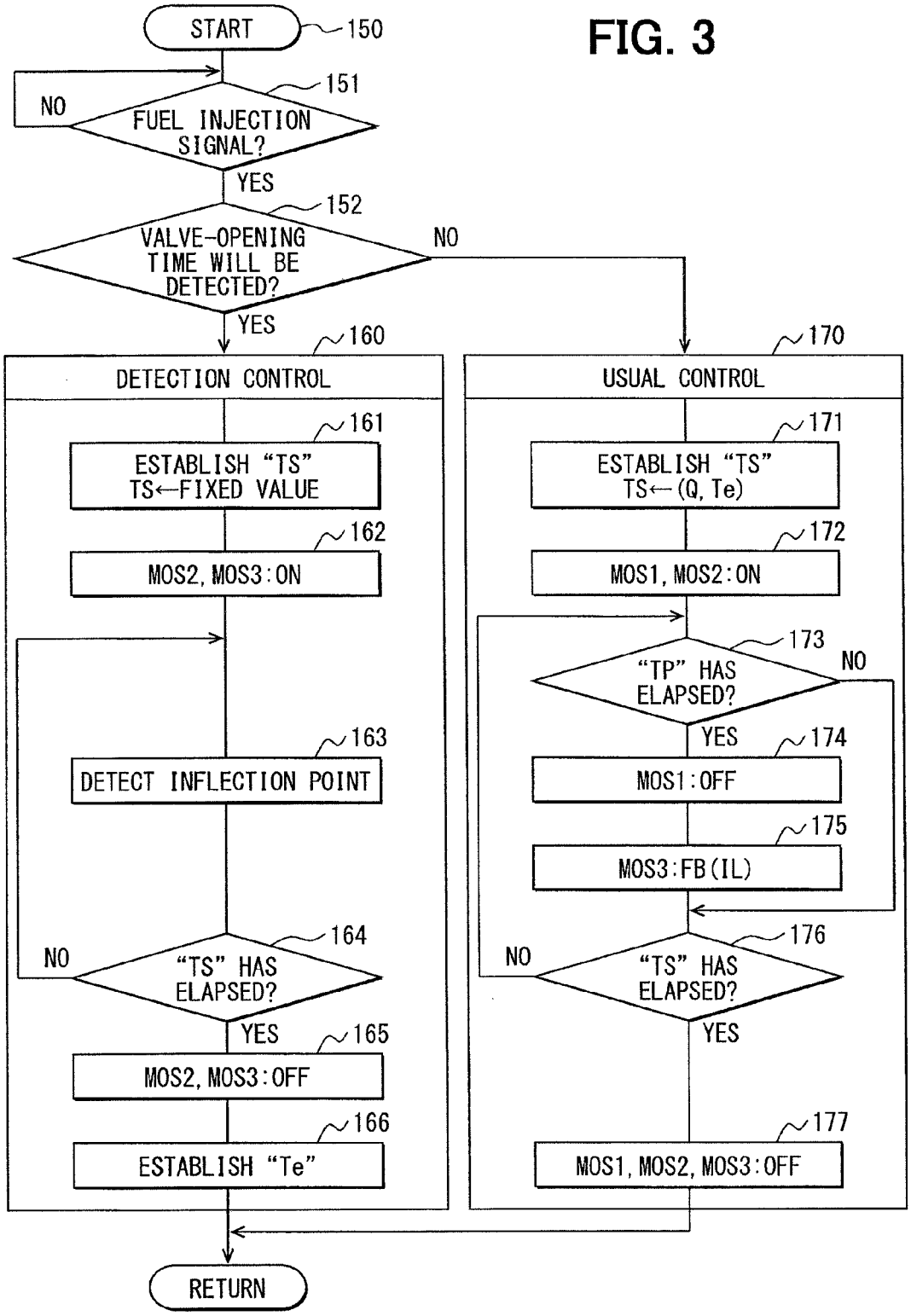
FIG. 3 is a flowchart illustrating a control processing according to the first embodiment.

FIG. 3 is a flowchart showing a processing for controlling the drive circuit 6. The ECU 5 executes the control processing when the fuel injection is permitted. In step 151, the ECU 5 determines whether a fuel injection signal is generated. When no fuel injection signal is generated, the process in step 151 is repeated. When the fuel injection signal is generated in step 151, the procedure proceeds to step 152.

In step 152, the ECU 5 determines whether a detection of the valve-opening time should be conducted by the detection control portion 7*f* and the valve-open detecting portion 7*c*. An execution time of the valve-opening time detection is established in step 152.

The detection of the valve-opening time is performed only while the internal combustion engine 2 is running. The detection control portion 7*f* needs a relatively long valve opening period. For this reason, only when a long valve opening period can be provided, the detection of the valve-opening time is performed. For example, when a large quantity of fuel injection is necessary, the detection is performed.

It is likely that the detection of the valve-opening time may deteriorate an accuracy of fuel injection quantity. Thus, it is preferable that the detection of the valve-opening time is performed sporadically in multiple fuel injections. For example, the detection of the valve-opening time is performed intermittently.

The detection of the valve-opening time may be performed intermittently at low frequency irrespective of the driving condition of the internal combustion engine 2. The determination condition in step 152 is established in such a manner that the frequency of the fuel injection by the detection control portion 7*f* is less than the frequency of the fuel injection by the usual-control portion 7*b*.

When the answer is YES in step 152, the procedure proceeds to step 160. In step 160, the ECU 5 performs a fuel injection for detecting the valve-opening time.

In step 161, the ECU 5 establishes the electric supply period "TS". The electric supply period "TS" for detecting the valve-opening time is a fixed value.

In step 162, the ECU 5 turns ON the MOS2 and the MOS3. As a result, the low valve-opening voltage "VF2" is supplied to the coil 3*c* from the low voltage supply 6*b*. The electric current flows through the coil 3*c*, and the coil 3*c* is magnetized. The needle 3*b* is attracted towards the stator 3*a*. The fuel injector 3 starts a valve opening action. The needle 3*b* is lifted up gradually slowly. When the needle 3*b* is lifted up gradually, the inductance of the coil 3*c* varies. Then, the needle 3*b* stops at the full-open position. For this reason, a transitional variation appears also in the inductance of the coil 3*c*. Such a variation of the inductance generates the inflection point on the waveform of electric current "IL".

In step 163, the ECU 5 detects the inflection point on the waveform of electric current "IL". The detection of the inflection point can be performed by mathematical processing, such as differentiation and/or integration.

In step 164, the ECU 5 determines whether the electric supply period "TS" has elapsed. Until the electric supply period "TS" has elapsed, the ECU 5 repeats the process in step 163. When the electric supply period "TS" has elapsed, the procedure proceeds to step 165.

In step 165, the ECU 5 turns OFF the MOS2 and the MOSS. Thereby, the supply of low valve-opening voltage "VF2" is terminated. The magnetization of the coil 3*c* is also terminated. The needle 3*b* stops the movement in the valve-open direction and then starts to be apart from the stator 3*a*. That is, the fuel injector 3 starts a valve closing operation before being fully opened. The lift amount of the needle 3*b* decreases gradually.

In step 166, the ECU 5 establishes the correction amount "Te" based on the currently obtained valve-opening time. The correction amount "Te" is for obtaining a target fuel injection quantity "Q" by compensating the error of the fuel injection quantity due to an error of the valve-opening time in a succeeding usual fuel injection. The process in step 166 corresponds to the correction-amount computing portion 7*d*.

When the answer is NO in step 152, the procedure proceeds to step 170. In step 170, the ECU 5 performs the usual fuel injection during which no valve-opening time is detected.

In step 171, the ECU 5 establishes the electric supply period "TS". The electric supply period "TS" is established in such a manner as to obtain the target fuel injection quantity "Q2 by supplying the high valve-opening voltage "VF1" and the low valve-opening voltage "VF2". The correction amount "Te" obtained in step 166 is added to the electric supply period "TS". Thus, the correction amount "Te" is reflected only for a succeeding usual valve-open control.

In step 172, the ECU 5 turns ON the MOS1 and the MOS2. As a result, the high valve-opening voltage "VF1" is supplied to the coil 3*c* from the high voltage supply 6*a*. The electric current flows through the coil 3*c*, and the coil 3*c* is magnetized at high speed. The needle 3*b* is attracted towards the stator 3*a* at high speed. The fuel injector 3 starts a valve opening action at high speed. The needle 3*b* is lifted up at high speed.

In step 173, the ECU 5 determines whether an initial period "TP" in the electric supply period "TS" has elapsed. During the initial period "TP", the high valve-opening voltage "VF1" is supplied. When the initial period "TP" has elapsed, the procedure proceeds to step 174.

In step 174, the ECU 5 turns OFF the MOS1. In step 175, the ECU 5 starts a switching control of the MOS3. The ECU 5 controls the MOS3 in such a manner that the electric current "IL" flowing through the coil 3*c* agrees with the target current. As a result, the low valve-opening voltage "VF2" is supplied to the coil 3*c* from the low voltage supply 6*b*. The target current is established in such a manner as to maintain the fuel injector 3 at the full-open position. The target current is smaller than the maximum current which the low voltage supply 6*b* can supply to the coil 3*c*. The target current is established as the minimum electric current which can maintain the fuel injector 3 at the full-open position. As a result, the coil 3*c* is magnetized state at the minimum level.

In step 176, the ECU 5 determines whether the electric supply period "TS" has elapsed. Until the electric supply period "TS" has elapsed, the ECU 5 continues the electric supply to the coil 3*c*. During the electric supply period "TS", the ECU 5 repeats the processes in steps 173 to 175. When the electric supply period "TS" has elapsed, the procedure proceeds to step 177.

In step 177, the ECU 5 turns OFF the MOS1, the MOS2 and the MOS3. Thereby, the supply of valve-opening voltage is terminated. The magnetization of the coil 3*c* is also terminated. The needle 3*b* stops the movement in the valve-open direction and then starts to be apart from the stator 3*a*. The lift amount of the needle 3*b* decreases gradually.

Figure 4:
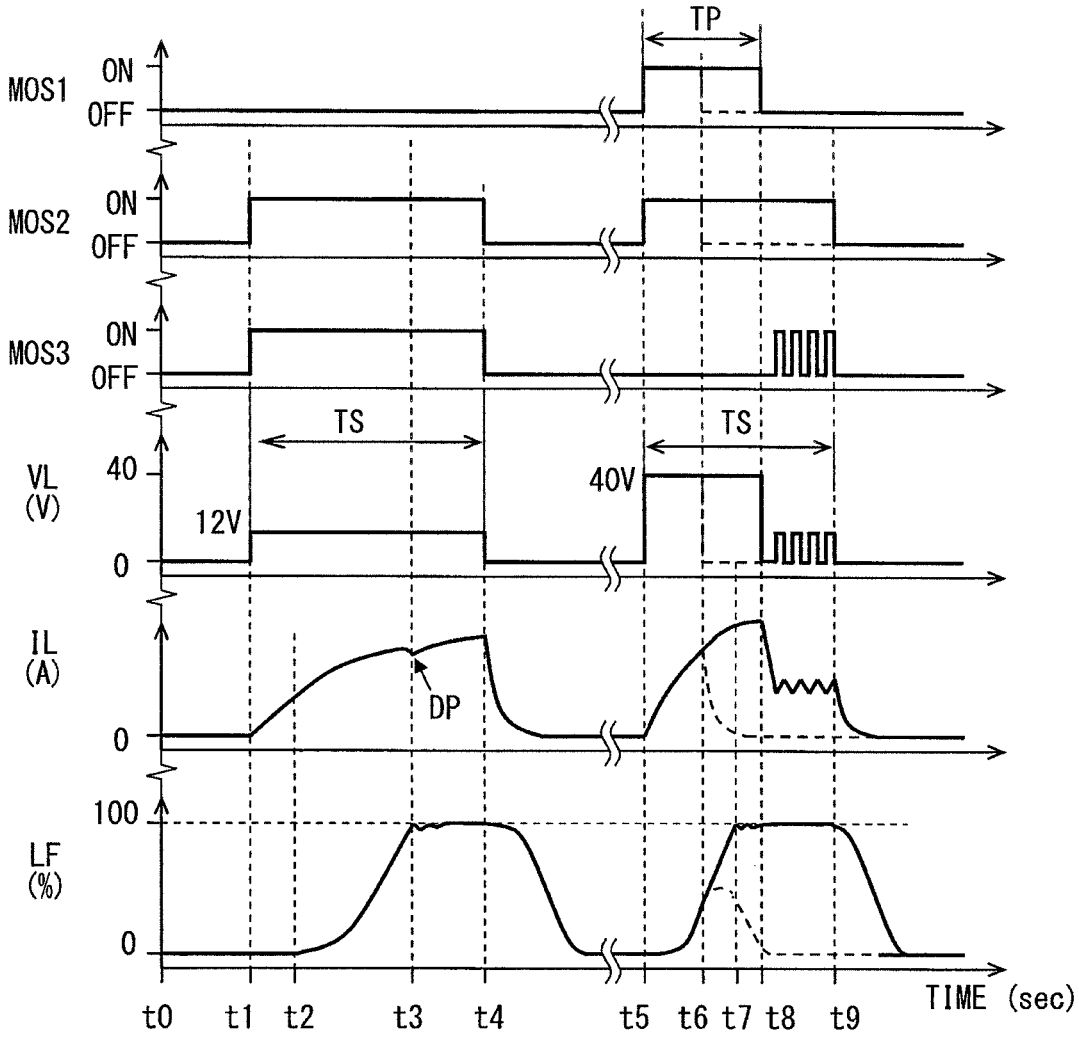
FIG. 4 is a time chart showing an operation according to the first embodiment.

FIG. 4 is a time chart showing an operation of the present embodiment. "VL" denotes the voltage at a plus terminal of the coil 3*c*, "IL" denotes the electric current flowing through the coil 3*c*, and "LF" denotes the lift amount of the needle 3*b*. FIG. 4 illustrates that two fuel injections are performed. The waveforms of "t1" to "t4" show the valve opening operation by the low valve-opening voltage "VF2". That is, the waveforms of "t1" to "t4" show the case where the inflection point detection processing (step 160) is performed. The waveforms of "t5" to "t9" show the valve opening by the high valve-opening voltage "VF1". In the waveforms after "t5", solid lines show a case where the electric supply period "TS" is long and a current control is performed. Dashed lines show a case where the small amount fuel injection is performed.

At the time "t1", the low valve-opening voltage "VF2" is supplied to the coil 3*c*. The electric current "IL" is gradually increased. At the time "t2", the lift amount "LF" of the needle 3*b* starts increasing.

At the time "t3", the lift amount "LF" becomes 100%. At this moment, an inflection point "DP" appears on the waveform of electric current "IL". At the inflection point "DP", the electric current "IL" is temporarily decreased. The Inflection point DP is detected by the valve-open detecting portion 7*c* (step 163). In the present embodiment, the valve-opening time is "t3". Based on the detected valve-opening time, the valve-open-delay period is obtained.

After the electric supply period "TS" has elapsed, the MOS2 and the MOS3 are turned OFF. The electric current "IL" is rapidly decreased and the lift amount "LF" is also decreased.

At the time "t5", the high valve-opening voltage "VF1" is supplied to the coil 3*c*. The electric current "IL" is rapidly increased. At the time "t7", the lift amount "LF" becomes 100%. At this moment, no inflection point appears on the waveform of electric current "IL". When the initial period "TP" has passed at "t8", the MOS1 is turned OFF. The switching control of the MOS3 is started. As a result, the low valve-opening voltage "VF2" is intermittently supplied to the coil 3*c*. The electric current "IL" is controlled to the target current. The lift amount "LF" is maintained at a full open condition. After the electric supply period "TS" has elapsed at "t9", the MOS2 is turned OFF. At the same time, the switching control of the MOS3 is completed. As the result, the electric current "IL" is gradually decreased and the lift amount "LF" is also gradually decreased.

As shown by dashed lines, at the time "t5", the high valve-opening voltage "VF1" is supplied to the coil 3*c*. The electric current "IL" is rapidly increased. In a case of small injection quantity, the electric supply period "TS" elapses before the fuel injector 3 is positioned at the full-open position. In the present embodiment, the electric supply period "TS" elapses at "t6". The MOS1, the MOS2 and the MOS3 are turned OFF at "t6". The electric current "IL" is rapidly decreased and the lift amount "LF" is also decreased.

As stated above, according to the present embodiment, the valve-opening time of the fuel injector 3 can be detected based on the inflection point "DP" which appears when the low valve-opening voltage "VF2" is supplied to the coil 3*c*. Thus, the valve-opening time can be correctly detected. Moreover, the inflection point can be detected by a relatively easy mathematical method. Therefore, a computing load of the CPU 7 can be restricted.

Moreover, since a valve-opening time is detected correctly, the electric supply period in succeeding fuel injection can be corrected. As a result, the error of fuel injection quantity is restricted. The fuel injection quantity can be controlled with high accuracy.

Furthermore, according to the present embodiment, the small injection quantity can be obtained by stopping the valve-opening voltage before the fuel injector 3 is positioned at the full-open position. The error of the valve-opening time gives a significant influence to the small injection quantity. However, according to the present embodiment, since the error of a valve-opening time can be compensated, the small injection quantity can be obtained correctly.

According to the present embodiment, the correction amount "Te" is applied only to the electric supply period TS of the usual valve open control. The correction amount "Te" is not applied to the fuel injection control for detecting the valve-opening time. However, since the fuel injection control for detecting the valve-opening time is performed intermittently, the valve-opening time can be detected without deteriorating the driving condition of the internal combustion engine 2.

Other Embodiment

The preferred embodiment is described above. The present disclosure is not limited to the above embodiment.

For example, the control units can be configured by software, hardware or a combination thereof. Also, the control unit can be configured by an analog circuit.

When the fuel injector 3 is fully closed, both terminals of the coil 3*c* may be short-circuited or grounded.

Moreover, after the electric supply period "TS", a reverse voltage relative to the valve-opening voltage may be supplied.

Moreover, the voltage values of the high voltage supply 6*a* and the low voltage supply 6*b* can be changed.

The electric supply period "TS" may be established according to the fuel injection quantity "Q". In this case, the target fuel injection quantity "Q" can be obtained by the low valve-opening voltage "VF2".

What is claimed is:

1. A fuel injection controller which has terminals connectable to a coil of a fuel injector, comprising:

a usual-control portion which supplies a high valve-opening voltage to the terminals in order to perform a first-speed fuel injection by the fuel injector;

a detection control portion which supplies a low valve-opening voltage lower than the high valve-opening voltage to the terminals in order to perform a second-speed fuel injection by the fuel injector, the second-speed fuel injection being different and less than the first-speed fuel injection;

a valve-open detecting portion which detects the fuel injector is positioned at a full-open position during the second-speed fuel injection by detecting an inflection point on a waveform of an electric current flowing through the coil only when the low valve-opening voltage is supplied, the valve-open detecting portion identifies a valve-opening time at which the fuel injector is positioned at a full-open position during the second-speed fuel injection; and a correction processing portion which corrects a parameter in a succeeding fuel injection performed by the usual-control portion, based on the valve-opening time of the second-speed fuel injection detected in a preceding fuel injection performed by the detection control portion so that an error of a fuel injection quantity due to an error of the valve-opening time in the succeeding fuel injection performed by the usual-control portion is decreased.

2. A fuel injection controller according to claim 1, wherein the detection control portion intermittently performs a detection of a valve-opening time.

3. A fuel injection controller according to claim 1, wherein a frequency of the second-speed fuel injection by the detection control portion is less than a frequency of the first-speed fuel injection by the usual-control portion.

4. A fuel injection controller according to claim 1, wherein the parameter is an electric supply period to the fuel injector.

5. A fuel injection controller according to claim 1, wherein the usual-control portion stops a supply of the high valve-opening voltage before the fuel injector is positioned at full-open position.

6. A fuel injection controller according to claim 1, wherein the valve-open detecting portion detects the inflection point by a differentiation processing and an integration processing.

7. The fuel injection controller according to claim 1, wherein the valve-open detecting portion detects the inflection point by a differentiation processing.

8. The fuel injection controller according to claim 1, wherein the valve-open detecting portion detects the inflection point by an integration processing.

9. The fuel injection controller according to claim 1, wherein the low valve-opening voltage drives the fuel injector slower than the high valve-opening voltage so that the inflection point can be detected from the low valve-opening voltage.

10. The fuel injection controller according to claim 1, wherein the waveform of the electric current flowing through the coil results from, and is based on, the low valve-opening voltage.

11. A method for controlling a fuel injector, comprising:

in a fuel injection controller connectable to a coil of a fuel injector via terminals, supplying a high valve-opening voltage during an electric supply period to the terminals of the fuel injector coil in order to control a first-speed fuel injection by the fuel injector;

supplying a low valve-opening voltage, which is lower than the high valve-opening voltage, to the terminals of the fuel injector coil so that the low valve-opening voltage controls the fuel injector to make a second-speed fuel injection that is slower than the first-speed fuel injection;

detecting, after the supplying of the low valve-opening voltage, an inflection point on a waveform of an electric current flowing through the coil while the low valve-opening voltage is being supplied in order to determine whether the fuel injector is at a full-open position during the second-speed fuel injection;

determining, after the detecting of the inflection point of the second-speed fuel injection, the valve-opening time of the fuel injector based on, and in response to, the inflection point of the waveform resulting from the low valve-opening voltage;

determining a valve-opening time error based on, and in response to, the valve-opening time of the fuel injector during the second-speed fuel injection and an intended target valve-opening time of the fuel injector; and adjusting, after the determining of the valve-opening time error, the electric supply period of the high valve-opening voltage in order to accommodate for, and to correct, the valve-opening time error as a target valve-opening correction time determined from the second-speed fuel injection.

12. The method according to claim 11, further comprising increasing the electric supply period of the high valve-opening voltage in response to the valve-opening time of the second-speed fuel injection being shorter than the target valve-opening correction time, and decreasing the electric supply period of the high valve-opening voltage in response to the valve-opening time of the second-speed fuel injection being longer than the target valve-opening correction time.

13. The fuel injection controller of claim 1, wherein the detection control portion is configured to supply the high valve-opening voltage only during the first-speed fuel injection, and to supply the low valve-opening voltage only during the second-speed fuel injection.

14. The fuel injection controller of claim 1, wherein the inflection point occurs during the second-speed fuel injection driven by the low valve-opening voltage.

* * * * *